US007163491B2

(12) United States Patent
Rufino

(10) Patent No.: US 7,163,491 B2
(45) **Date of Patent: *Jan. 16, 2007**

(54) EPICYCLIC GEAR EXERCISE DEVICE

(75) Inventor: John Rufino, Whittier, CA (US)

(73) Assignee: Unisen, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/720,834

(22) Filed: Nov. 24, 2003

(65) Prior Publication Data

US 2004/0180760 A1 Sep. 16, 2004

Related U.S. Application Data

(63) Continuation of application No. 09/456,743, filed on Dec. 7, 1999, now Pat. No. 6,685,598.

(51) Int. Cl.
*A63B 71/00* (2006.01)

(52) U.S. Cl. ..... 482/51; 482/57; 482/60

(58) Field of Classification Search ..... 482/51–53, 482/57–65

See application file for complete search history.

(56) References Cited

U.S. PATENT DOCUMENTS

| | | | | |
|---|---|---|---|---|
| 3,316,898 | A | 5/1967 | Brown | |
| 4,168,495 | A | 9/1979 | Sweeney | |
| 4,193,324 | A * | 3/1980 | Marc | 475/349 |
| 4,312,033 | A | 1/1982 | Sweeney et al. | |
| 4,353,019 | A | 10/1982 | Sweeney, Jr. | |
| 4,509,742 | A | 4/1985 | Cones | |
| 4,786,068 | A | 11/1988 | Tang | |
| 5,562,574 | A | 10/1996 | Miller | |
| 5,690,589 | A | 11/1997 | Rodgers, Jr. | |
| 5,707,321 | A | 1/1998 | Maresh | |
| 5,788,609 | A | 8/1998 | Miller | |
| 5,833,583 | A * | 11/1998 | Chuang | 482/60 |
| 6,027,430 | A * | 2/2000 | Stearns et al. | 482/51 |

* cited by examiner

*Primary Examiner*—Jerome Donnelly
*Assistant Examiner*—Tam Nguyen
(74) *Attorney, Agent, or Firm*—Knobbe, Martens, Olson & Bear, LLP

(57) ABSTRACT

An improved elliptical path exercise machine is provided that is simple and robust in its construction, requires minimal maintenance, provides smooth even exercise motion, and which has a compact foot-print. The apparatus includes a pair of planetary gears, sun/ring gears and at least one crank. The crank is supported and arranged so as to be rotatable about a crank axis. Each planetary gear is pivotably secured to the crank about a pivot point located and arranged such that as the crank is rotated the planetary gears engage and rotate relative to their corresponding sun/ring gears while simultaneously revolving about the crank axis so as to form right and left epicylic gear trains. Two foot pedals are each pivotably secured to a corresponding one of the planetary gears and are sized and arranged to support the feet of a user. The layout and geometries of the device are such that each foot-pedal follows a substantially elliptical foot-path as the crank is rotated. The major axis of the elliptical foot-path is greater than twice the effective crank-arm length of the crank so that a compact foot print is attained.

5 Claims, 6 Drawing Sheets

EPICYCLIC GEAR EXERCISE DEVICE

CROSS REFERENCE TO RELATED APPLICATION

This application is a continuation of U.S. application Ser. No. 09/456,743, filed Dec. 7, 1999 now U.S. Pat. No. 6,685,598.

BACKGROUND OF THE INVENTION

1. Field of the Invention

The present invention relates to an exercise apparatus for providing simulated walking or running motion and, in particular, a simple, compact exercise apparatus for producing a generally elliptical foot path motion using a combination of epicyclic, planetary and/or sun/ring gears.

2. Description of the Related Art

The benefits of regular exercise to improve overall health, fitness and longevity are well documented in the literature. Medical science has consistently demonstrated the improved strength, health, and enjoyment of life which results from physical activity. Aerobic exercises, such as jogging and walking, are particularly popular and medically recommended exercises for conditioning training and improving overall health and cardiovascular efficiency.

However, modern lifestyles often fail to accommodate accessible running or walking areas. In addition, inclimate weather and other environmental and social factors may cause individuals to remain indoors as opposed to engaging in outdoor physical activities.

There are also certain dangers and/or health risks associated with walking, jogging or running on natural outdoor surfaces. For example, medical experience has demonstrated that knee and ankle joints are often strained or injured when joggers run on paved or uneven surfaces or jogging paths which change direction often. Other examples of common injuries resulting from jogging, particularly on uneven terrain, may include foot sores, pulled or strained muscles, strained tendons and cartilage, back injuries, and head injuries, not to mention the risk of physical harm from pedestrian crossing accidents or even criminal activity. Thus, many exercise enthusiasts prefer the safety and convenience of an in-home or commercial exercise machine in order to provide desired exercise without the attendant inconvenience and risk of outdoor exercise.

Presently available indoor exercise devices for commercial or home use come in a wide variety of sizes and configurations. Typical indoor exercise devices may include, for example, stationary bicycles for simulating bicycle pedaling action, simulated stepping machines for simulating or replicating the motion associated with stair stepping exercise, and treadmills for simulating running, jogging, or walking. Other popular exercise devices include ski simulators and a wide variety of weight lifting or resistance training exercise equipment.

Each of these exercise machines has particular advantages and disadvantages for accomplishing a desired fitness goal. For example, treadmills generally permit a user to walk, jog or run on a stationary platform or endless belt. As such, treadmills are particularly well suited for general fitness and endurance training. However, the foot impact associated with walking or running may be undesirable in some cases due to advanced age, pregnancy, or other health conditions. In those cases it may be beneficial for the user to engage in a more low impact or non-impact exercise.

Cycling simulators, ski simulators, and stair simulators are particularly noted for the elimination of impacts affecting the hips, knees, ankles, and feet of a user. However, such exercise machines have a limited range of motion such that certain muscle groups are often not fully exercised to the degree desired by the user. In particular, these machines do not faithfully reproduce what many consider to be the most natural and beneficial exercise motions—namely, walking and running.

More recently, elliptical foot path exercise devices have been introduced into the market and have become popular for both home and commercial use. These devices provide a broader range of foot motion generally tracing a path approximating an ellipse or modified ellipse. For example, U.S. Pat. No. 5,299,993 to Stearns shows a modified stair stepping exercise machine which incorporates both vertical and horizontal movement using a combination of linkages to guide the foot pedals in an elliptical or ovate path. Habing in U.S. Pat. Nos. 5,299,993 and 5,499,956 provides articulated linkages controlled through cables by motor to move the foot pedals through an ovate path. Both devices guide the foot pedals using linkages and rollers operating against a linear guide track.

Like Stearns and Habing, most conventional elliptical exercise devices employ a variety of moving parts, such as linkages, pivots, slide tracks and other components to attain a desired elliptical foot path. These moving components are not only expensive to manufacture and assemble, but are subject to increased wear and incidence of malfunction or breakage. Thus, significant upkeep and repair is required to maintain these devices in good working order. Also, it is unavoidable that the various moving components must have a certain mass and, thus, the dynamics and changing velocities and accelerations of the individual linkages and other moving components can often impart to the exercise machine an undesirable uneven stride motion or "kick". This can make the device more difficult to use and decrease the smoothness and non-impact gliding ability of the exercise machine. Excessive acceleration of particularly massive linkages can cause undesired torsional or bending strain within associated support and pivot members, increasing wear and the risk of potential catastrophic failure.

Another drawback of many conventional elliptical path exercise machines is the relatively large amount of space occupied by the machine's "foot-print." The foot-print is the amount of floor area an exercise machine occupies when properly set up, giving due consideration for any additional clearances required for safe operation of the machine and for ingress and egress of users. Smaller foot-print machines are more desirable for commercial use, such as in gyms, health spas and the like, because of the cost of renting and maintaining commercial floor space.

Notably, many of the prior art elliptical exercise devices utilize foot pedals that are rigidly attached to extended foot linkages. These foot linkages, in turn, are provided in connected relationship between a crank at one end and a guide or reaction roller at the other end. Therefore, in a typical multi-bar linkage elliptical exercise machine the longest dimension of the machine's foot print typically extends well beyond the major axis of the elliptical foot path. This is due to the fact that the axis of the crank as it turns a wheel or other device when considered with the axis of the connection at the end of the crank limits the overall stroke distance to the working diameter of the crank or twice the crank arm length, which forms the major axis of the elliptical path. Also, the reaction roller is typically required to be situated well rearward of the foot linkage in order to provide the desired amount of vertical displacement in the elliptical path motion.

For example to achieve a sixteen inch length in the major axis of the elliptical foot-path of a conventional elliptical path trainer, the crank of the trainer needs to have a longer crank arm length than half the length which would be eight inches. This takes into account the journaling and bearing mountings. From a practical standpoint in order to provide a sixteen inch length of the major axis of the elliptical path, a nine inch long crank must be utilized to provide approximately an eighteen inch diameter circle. In addition, the foot linkage may extend another twenty-four to thirty-six inches rearward beyond the point of attachment to the crank to engage a guide roller. Thus, the total displacement of the crank and linkage required to achieve a sixteen inch running stride could be as long as forty to fifty inches or more. This translates into an undesirably large or elongated foot print relative to the length of the stride path achieved.

SUMMARY OF THE INVENTION

Accordingly, it is a principle object and advantage of the present invention to overcome some or all of these limitations by providing an improved elliptical path exercise machine that is simple and robust in its construction, requires minimal maintenance, provides smooth even exercise motion, and which has a compact foot-print.

In accordance with one embodiment the present invention provides an exercise apparatus for providing simulated walking or running motion. The apparatus includes a pair of planetary gears, sun/ring gears and at least one crank. The crank is supported and arranged so as to be rotatable about a crank axis. Each planetary gear is pivotably secured to the crank about a pivot point located and arranged such that as the crank is rotated the planetary gears engage and rotate relative to their corresponding sun/ring gears while simultaneously revolving about the crank axis so as to form right and left epicyclic gear trains. Two foot pedals are each pivotably secured to a corresponding one of the planetary gears and are sized and arranged to support the feet of a user. The layout and geometries of the device are such that each foot-pedal follows a substantially elliptical foot-path as the crank is rotated.

In accordance with another embodiment the present invention provides an exercise apparatus for providing simulated walking or running motion comprising a support frame and at least one crank pivotably supported relative to the support frame so as to be rotatable about a crank axis. At least one planetary gear is pivotably supported relative to the crank and is rotatable therewith. At least one sun/ring gear is also supported relative to the support frame and sized and positioned to engage the planetary gear so as to form an epicyclic gear train. A foot-pedal is pivotably supported relative to the planetary gear for supporting a user's foot. The layout and geometries of the device are such that the foot-pedal follows a substantially elliptical foot-path as the crank is rotated. Optionally, the effective working diameter of the planetary gear is equal to one-half the effective working diameter of the sun/ring gear and twice the effective crank-arm length of the crank so that the foot-path remains stable and does not precess with each successive foot-path cycle. Desirably, the major axis of the elliptical foot-path is greater than twice the effective crank-arm length of the crank so that a compact foot print is attained.

In accordance with another embodiment the present invention provides an exercise apparatus for providing simulated walking or running motion and including a plurality of gears sized, positioned and supported relative to one another so as to form an epicyclic gear train. The plurality of gears includes at least one planetary gear to which a foot-pedal is pivotably secured and supported for receiving and supporting a user's foot. By virtue of the epicyclic motion of the planetary gear to which the foot-pedal is secured, the foot-pedal is caused to trace a substantially elliptical foot-path as the epicyclic gear train operates.

In accordance with another embodiment the present invention provides an elliptical foot-path exercise apparatus including a support frame and at least one crank having an effective crank-arm length and being pivotably supported relative to the support frame so as to be rotatable about a crank axis. A foot pedal is provided in mechanical communication with the crank. The foot pedal is sized and arranged relative to the crank so that it follows a substantially elliptical foot-path relative to the support frame and so that the major axis of the elliptical foot-path is greater than twice the effective crank-arm length.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
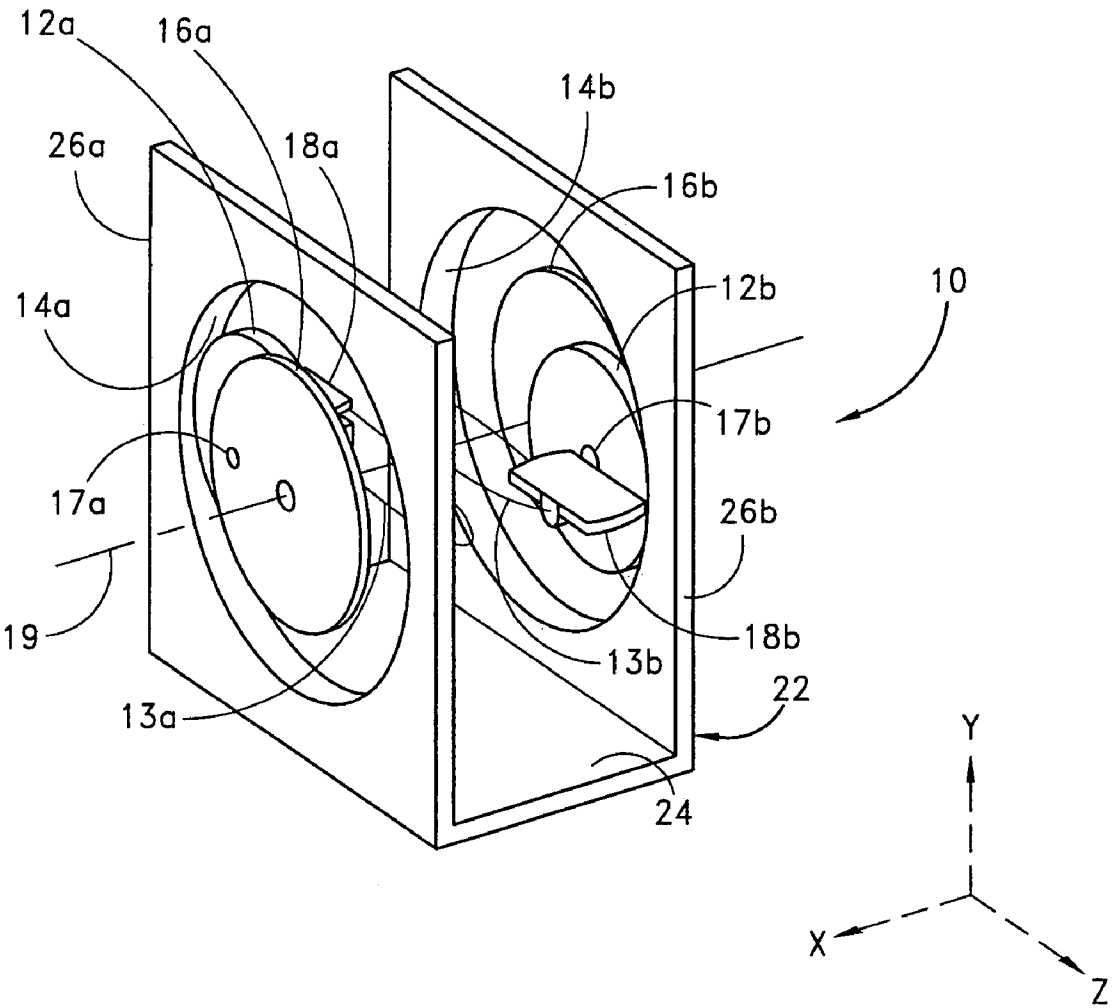
FIG. 1 is a perspective partial schematic view of one embodiment of an epicyclic gear exercise device having features in accordance with the present invention.

FIG. 1 is a perspective schematic view of one embodiment of an epicyclic gear exercise device 10 having features in accordance with the present invention. For purposes of describing certain aspects of the invention as embodied in the epicyclic gear exercise device 10 of FIG. 1 only the left side of the apparatus may be described. However, those skilled in the art will readily recognize that identical or similar structures are or may be incorporated on the right side of the apparatus and that such structures will or are intended to operate in a similar or identical manner. Alternatively, those skilled in the art will also recognize that certain structures described as having identical right and left counterpart structures may be combined into a single structure to simplify the construction of the device and reduce costs.

Fundamentally, the exercise device 10 comprises planetary gears 12*a*, 12*b*, sun/ring gears 14*a*, 14*b* and crank wheels 16*a*, 16*b*. Each planetary gear 12*a*, 12*b* is pivotably secured to each corresponding crank wheel 16*a*, 16*b* about a pivot point 17*a*, 17*b* and is sized and arranged such that as each crank wheel 16*a*, 16*b* is rotated, planetary gears 12*a*, 12*b* engage and rotate relative to the sun/ring gears 14*a*, 14*b* while simultaneously revolving about the crank axis 19. In this manner, each planetary gear 12*a*, 12*b*, its associated sun/ring gear 14*a*, 14*b* and crank 16*a*, 16*b* form an epicylic gear train. Foot pedals 18*a*, 18*b* are pivotably secured preferably to the inside of each corresponding planetary gear 12*a*, 12*b* and are sized and arranged to support the feet of a user while tracing substantially elliptical foot paths 13*a*, 13*b*.

The size and shape of the elliptical paths is determined by a number of controlled parameters, including the relative working diameters of the various gears and cranks involved and the positioning of the foot pedals 18*a*, 18*b* relative to the planetary gear pivot axes 17*a*, 17*b*. Positioning the foot pedals 18*a*, 18*b* closer to the planetary gear pivot axes 17*a*, 17*b* creates a wider ellipse while positioning them farther away creates a more narrow ellipse. If desired, suitable adjustment means such as slide tracks or multiple pivot connection points can be provided for adjusting the relative position of each foot pedal 18*a*, 18*b*.

To avoid cyclical precession of the elliptical foot paths 13*a*, 13*b* and to ensure a constant and predictable foot path motion, each planetary gear 12*a*, 12*b* preferably has an effective working diameter that is equal to one-half of the effective working diameter of the associated sun/ring gear 14*a*, 14*b*. Alternatively stated, the number of working teeth in the periphery of each planetary gear 12*a*, 12*b* is preferably equal to one-half the number of working teeth in the periphery of each sun/ring gear 14*a*, 14*b*. This ensures that each planetary gear will make exactly −2 rotations per +1 revolution about the crank axis 19 such that the foot pedals begin and end each foot-path cycle in the same position. Alternatively, each sun/ring gear may be counter-rotated or additional gearing may be provided as needed to counteract any such precession effects.

Other than as stated above, the particular size, shape and design of the various gears, cranks and pedals comprising the exercise device 10 are relatively unimportant. Based on the particular geometries of the preferred embodiment shown in FIG. 1, the crank wheels 16*a*, 16*b* preferably have a working diameter of at least about eight inches so as to provide a theoretical maximum sixteen inch length in the major axis of the elliptical foot paths 13*a*, 13*b*. The crank wheels 16*a*, 16*b* preferably have a working radius or effective crank-arm length of at least about four inches measured from the crank axis 19 to the planetary gear axes 17*a*, 17*b*. This dimension is also preferably equal to one-half the diameter of the associated planetary gear 12*a*, 12*b* so as to provide the above-noted anti-precession effect. The sun/ring gears 14*a*, 14*b* preferably have effective working diameters of at least about 16 inches.

The entire gear train structure shown and described above may be supported in a suitable frame, chassis or other support means adapted to secure the illustrated components in the operative relationship shown. This support means may comprise any variety of well known structures giving due consideration to the desired orientation and relationship between the various gears, cranks and pedals as shown. For example, FIG. 1 illustrates a simple U-shaped frame 22 having a base 24 and side walls 26*a*, 26*b*. The frame 22 may be formed from any variety of materials and components well known in the art, such as stainless steel or aluminum plates welded or bolted together. Preferably the frame 22 is sized, shaped and dimensioned so as to accommodate a human user supported on the foot pedals 18*a*, 18*b* of the epicylic gear exercise device 10.

Figure 2:
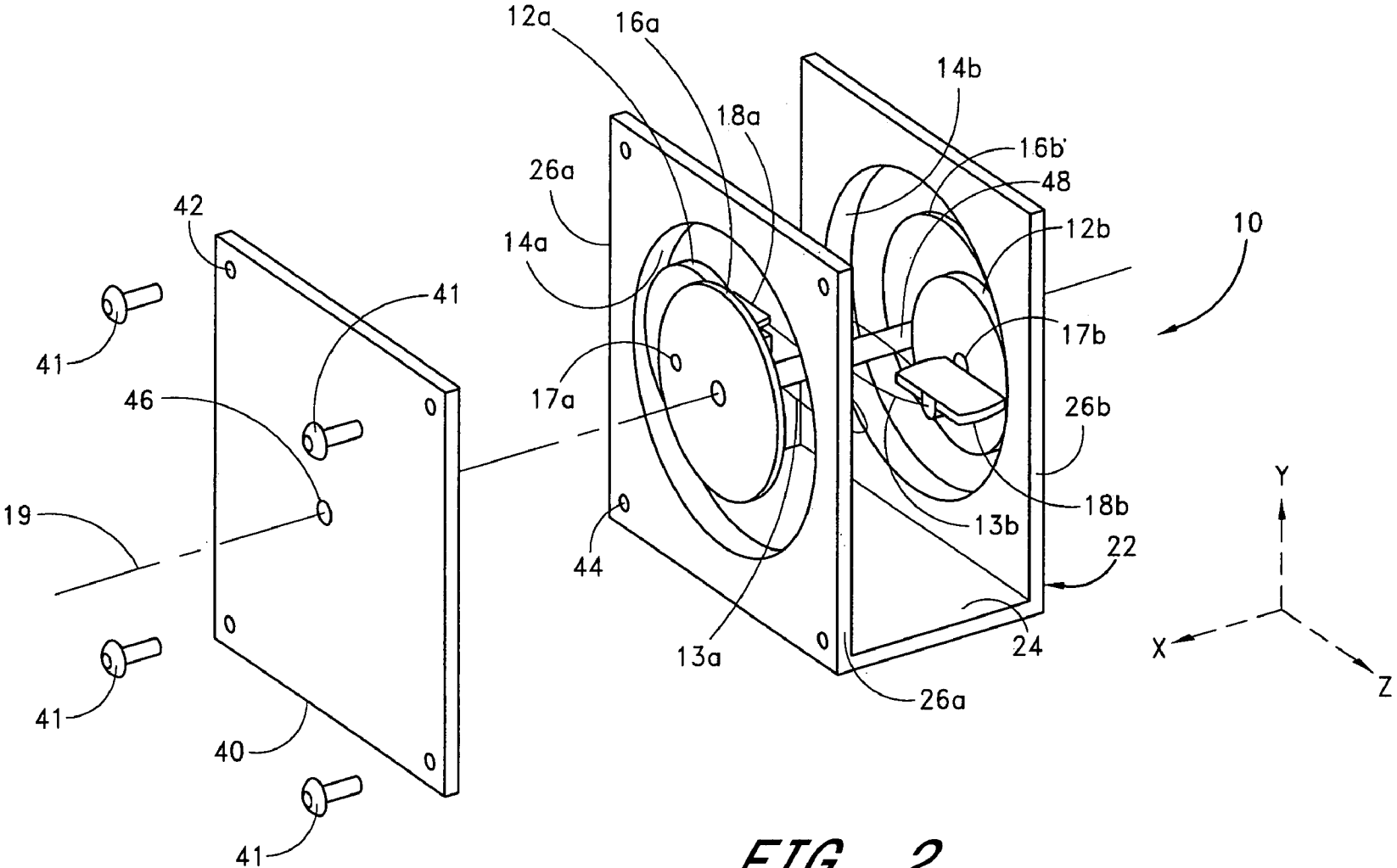
FIG. 2 is an exploded perspective partial schematic view of the epicyclic gear exercise device of FIG. 1 modified to include a crank wheel support plate and a central shaft connecting the right and left gear trains.

The crank wheels 16*a*, 16*b* can be similarly supported by a crank support plate 40, such as illustrated in the exploded view of FIG. 2. In FIG. 2 the support plate 40 is illustrated as being formed of a clear or translucent material such as plexiglass or acrylic. This is for purposes of illustration and/or aesthetic embellishment only. While such structures may be desirable for certain applications, such as demonstration equipment, it is not necessary to practice the invention. The plate 40 may alternately be formed of suitable grade stainless steel, aluminum or any variety of other well-known structural materials as desired, giving due consideration to the goal of securely supporting the crank wheel 16*a* as shown.

The plate 40 may be secured to the frame 22 via bolts 41 threaded through thru-holes 42 formed in plate 40 and threaded holes 44 formed in the side wall 26*a* of frame 22. A central aperture 46 is formed in the plate 40 and is sized and arranged to receive a support shaft, such as shaft 48, to pivotably support crank wheel 16*a*. The aperture 46 is preferably fitted with a bearing or insert into which the shaft 48 is journaled. While only one plate 40 is shown, those skilled in the art will readily recognize that another plate may be secured to the opposite side in a similar fashion to support crank wheel 16*b*. If desired, auxiliary support structures (not shown) may optionally be provided to support or assist the user in using the exercise device 10 and/or to provide means for simultaneous arm/hand exercise.

Figure 3:
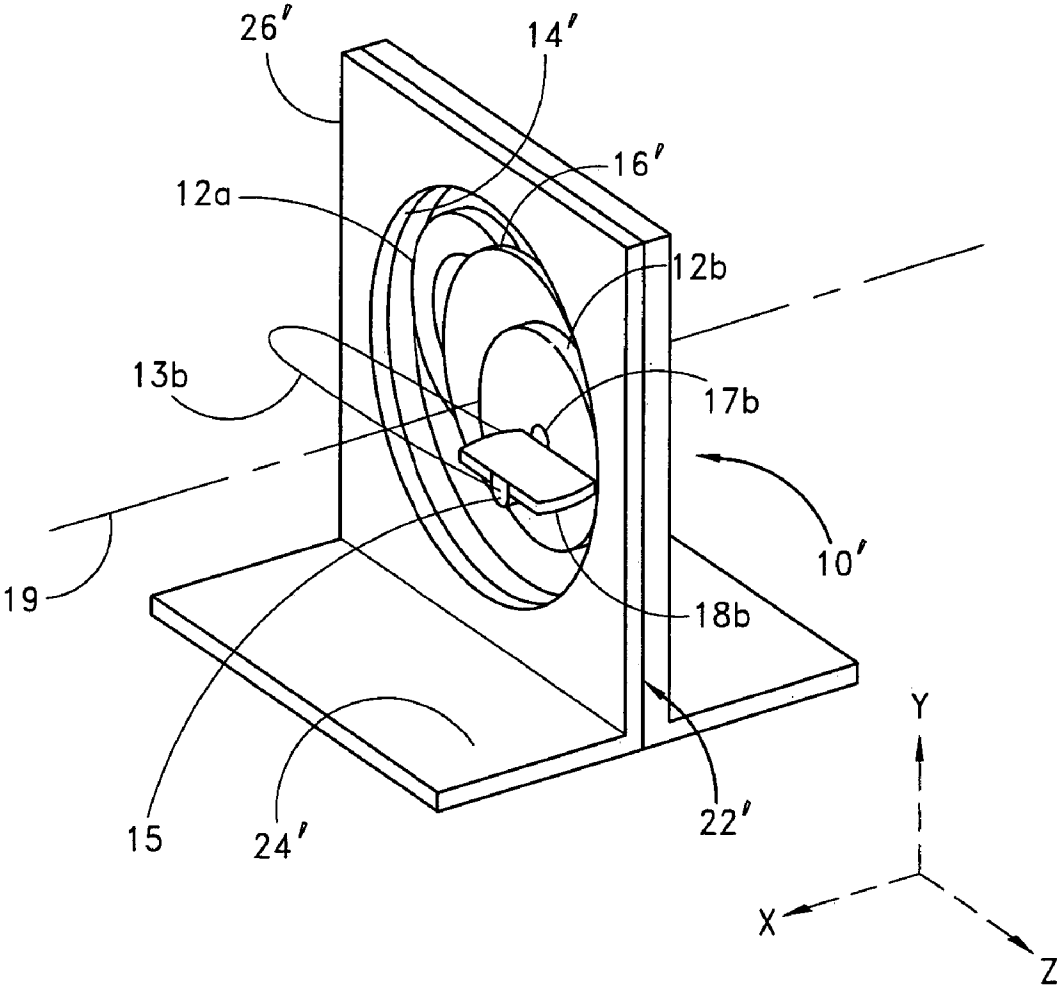
FIG. 3 illustrates a second modified embodiment of an epicyclic gear exercise device having features of the present invention.

Alternatively, those skilled in the art will readily recognize that a wide variety of other support structures and various other design configurations may be used while still enjoying the benefits and advantages of the invention as taught herein. For example, if desired the orientation of the right and left gear trains relative to one another may be reversed or inverted such that crank wheels 16*a*, 16*b* face each other and/or are combined into a single structure and such that foot pedals 18*a*, 18*b* are pivotably secured to the outside of each corresponding planetary gear 12*a*, 12*b*. FIG. 3 illustrates one such inverted embodiment of an epicyclic gear exercise device 10' having features of the present invention. For purposes of illustration and ease of understanding, like structures are denoted with like reference numerals. In the embodiment illustrated in FIG. 3, a single central crank wheel 16' and sun/ring gear 14' are used to provide right and left epicyclic gear trains. In this case, the foot pedals 18*a*, 18*b* are pivotably secured to the outer faces of the planetary gears 12*a*, 12*b* such that the user's feet would straddle the exercise device 10' when in use.

In each of the embodiments discussed above, the right and left gear trains are preferably coupled to a resistance device and/or a motor. This may be a common or shared resistance device and/or motor or they may be separate with each gear train having its own resistance device and/or motor. Any one of a variety of well known resistance devices and/or motors may be used, such as friction belts, fans, electric motors/generators and the like. Most preferably an electronically controlled motor/generator is used to provide variable mode operation between active (user driven) and passive (motor driven) exercise modes. Such a system is disclosed and described, for example, in U.S. Pat. No. 5,195,935 incorporated herein by reference.

If a shared resistance device and/or motor is used then a shaft 48 may be aptly sized and configured to connect the left side gear train to the right side gear train, as shown in the modified embodiment of FIG. 2, so that the foot pedals 18*a*, 18*b* are preferably maintained 180°apart. If necessary, the overall physical diameter of the planetary gears 12*a*, 12*b* may be reduced slightly while maintaining the desired gear ratio in order to provide adequate clearance for shaft 48. This may be accomplished by making slight adjustments to the gear pitch or tooth spacings. A suitable drive gear or pulley (not shown) may then be provided on the shaft 48 to couple both gear trains to a common resistance device.

Alternatively, the two gear trains may be maintained entirely or partially independent from one another. In that case other synchronizing means, such as internal or external gearing or regulators, may be used to coordinate or synchronize the foot pedals as desired. For example, electronic control circuitry associated with each resistance device or motor may alternately be used to vary the drive or load on each gear train to attain a desired synchronization between the right and left gear trains. Such synchronization may either be constant or variable throughout the stride path, as desired, to provide the most effective and beneficial stride motion.

Figure 4:
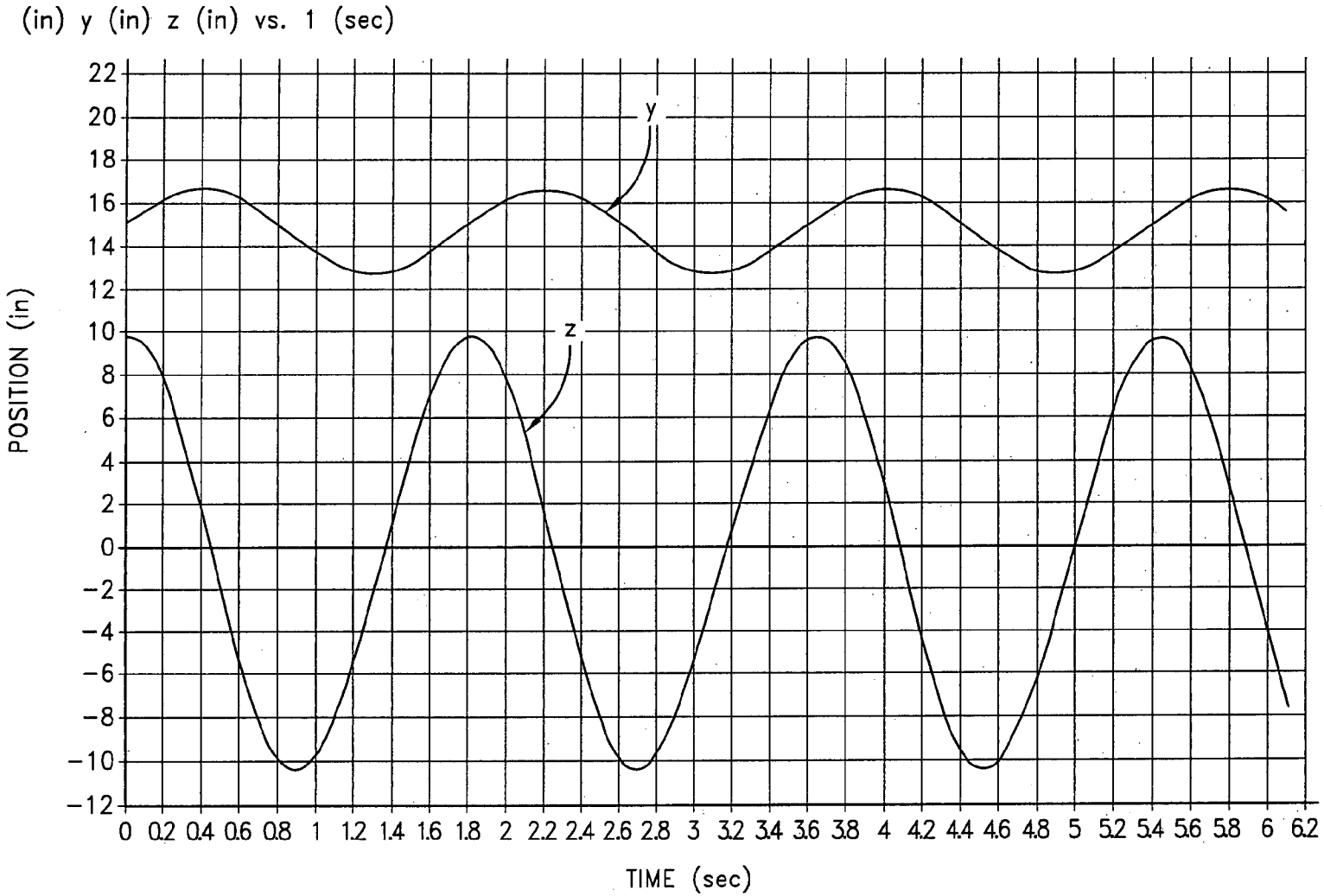
FIG. 4 is a graph of foot path displacement of the epicyclic gear exercise device of FIG. 1 along the Y and Z axes.

FIG. 4 is a graph of foot-pedal displacement of the epicyclic gear exercise device of FIG. 1 in both the Y and Z directions. As shown, the foot-pedal displacement "z" in the Z direction (stride length) follows a substantially smooth sinusoidal path from +10 inches at the beginning of each cycle at t=0, 1.80, 3.60 and 5.40 seconds, to −10 inches at the end of each first half-cycle at t=0.85, 2.65 and 4.45 seconds. The foot-pedal displacement "y" in the Y direction (stride height) similarly follows a substantially smooth sinusoidal path from +16.5 inches at the beginning of each cycle at t=0, 1.80, 3.60 and 5.40 seconds, to +12.5 inches at the end of each first half-cycle at t=0.85, 2.65 and 4.45 seconds.

Figure 5:
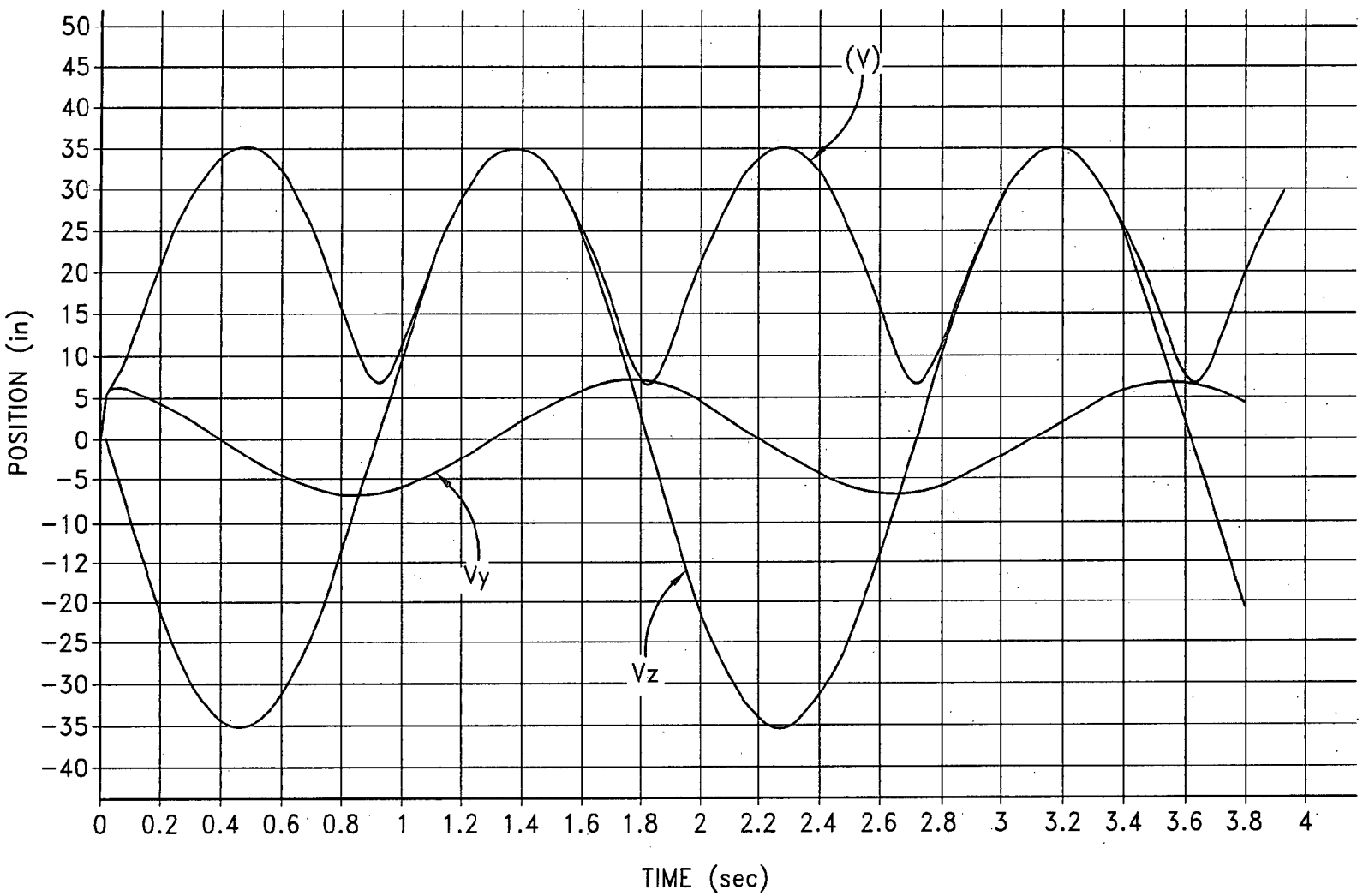
FIG. 5 is a graph of foot path velocity of the epicyclic gear exercise device of FIG. 1 along the Y and Z axes.

FIG. 5 is a graph of foot-pedal velocity of the epicyclic gear exercise device of FIG. 1 in both the Y and Z directions. As shown, the foot-pedal velocity $V_z$ in the Z direction (stride length) follows a substantially smooth sinusoidal path from 0 in./sec. at the beginning of each cycle at t=0 and 1.80 seconds, to −35 in./sec. at the end of each first quarter-cycle at t=0.45 and 2.35 seconds, through 0.0 in./sec again at the end of each second quarter-cycle at t=0.85 and 2.75, to +35 in./sec. at the end of each third quarter-cycle at t=1.35 and 3.15 seconds. The foot-pedal velocity $V_y$ in the Y direction (stride height) similarly follows a substantially smooth sinusoidal path from 7 in./sec. at the beginning of each cycle at t=0 and 1.80 seconds, through 0 in./sec. at the end of each first quarter-cycle at t=0.45 and 2.35 seconds, to −7 in./sec again at the end of each second quarter-cycle at t=0.85 and 2.75, to 0 in./sec. at the end of each third quarter-cycle at t=1.35 and 3.15 seconds. The absolute velocity |V| also follows a substantially smooth and continuous roughly sinusoidal path, as illustrated in FIG. 5, with the exception of a small transient response from t=0 to 0.05 seconds associated with initial start-up.

Figure 6:
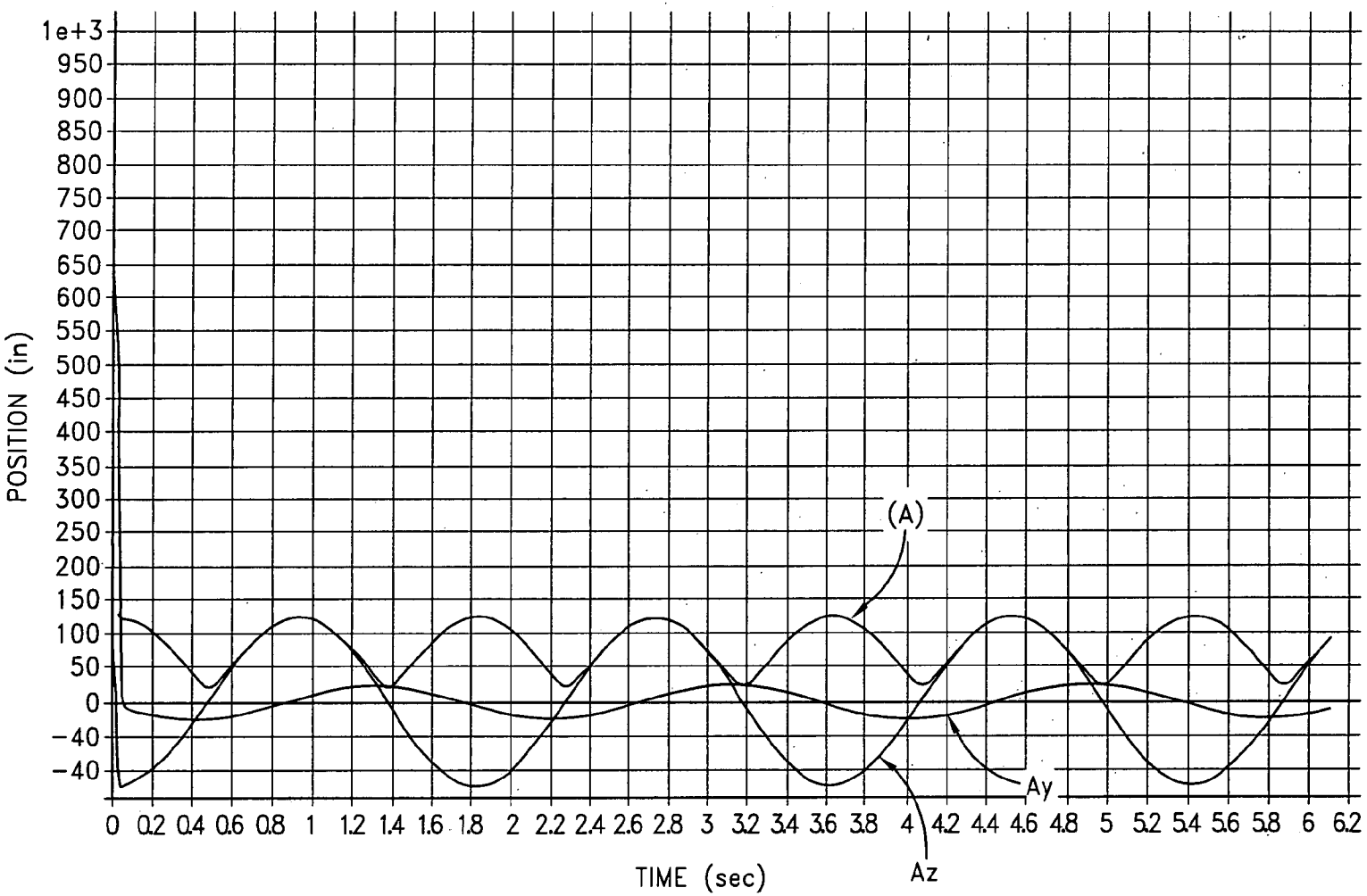
FIG. 6 is a graph of foot path acceleration of the epicyclic gear exercise device of FIG. 1 along the Y and Z axes.

FIG. 6 is a graph of foot-pedal acceleration of the epicyclic gear exercise device of FIG. 1 in both the Y and Z directions. As shown in FIG. 6, and with the exception of the transient response from t=0 to 0.05 the foot-pedal acceleration $A_z$ in the Z direction (stride length) follows a substantially smooth sinusoidal path from −125 in./sec$^2$ at the beginning of each cycle at t=0, 1.80, 3.6 and 5.4 seconds, through 0 in./sec$^2$ at the end of each first quarter-cycle at t=0.45, 2.35 and 4.1 seconds, to +125 in./sec$^2$ at the end of each second quarter-cycle at t=0.85, 2.75 and 4.45, and back through 0 in./sec$^2$ at the end of each third quarter-cycle at t=1.35, 3.15 and 4.95 seconds. The foot-pedal acceleration $A_y$ in the Y direction (stride height) similarly follows a substantially smooth sinusoidal path from 0 in./sec$^2$ at the beginning of each cycle at t=0, 1.80, 3.6 and 5.4 seconds, to −25 in./sec$^2$ at the end of each first quarter-cycle at t=0.45, 2.35 and 4.1 seconds, through 0 in./sec$^2$ again at the end of each second quarter-cycle at t=0.85, 2.75 and 4.45, and to +25 in./sec$^2$ at the end of each third quarter-cycle at t=1.35, 3.15 and 4.95 seconds. The absolute acceleration |A| also follows a substantially smooth and continuous roughly sinusoidal path, as illustrated in FIG. 6, again with the exception of the initial transient.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An exercise apparatus comprising:

a support frame and a ring gear supported by said support frame, said ring gear comprising an effective working diameter and being generally fixed relative to said support frame;

a crank supported for rotation about a crank axis relative to said support frame, said crank comprising an effective crank-arm length;

a planetary gear positioned within and engaged with said ring gear, said planetary gear being rotationally connected to said crank about a planetary gear axis and comprising an effective working diameter, said planetary gear axis being generally parallel to and offset from said crank axis;

a foot-pedal rotationally connected to said planetary gear, whereby said foot-pedal follows a substantially elliptical foot-path as pedal circulates about said planetary gear axis and said crank rotates about said crank axis; and said effective working diameter of said planetary gear being equal to one-half said effective working diameter of said ring gear.

2. An exercise apparatus comprising:

a support frame and a ring gear supported by said support frame, said ring gear comprising an effective working diameter and being generally fixed relative to said support frame;

a crank supported for rotation about a crank axis relative to said support frame, said crank comprising an effective crank-arm length;

a planetary gear positioned within and engaged with said ring gear, said planetary gear being rotationally connected to said crank about a planetary gear axis and comprising an effective working diameter, said planetary gear axis being generally parallel to and offset from said crank axis;

a foot-pedal rotationally connected to said planetary gear, whereby said foot-pedal follows a substantially elliptical foot-path as pedal circulates about said planetary gear axis and said crank rotates about said crank axis; and the number of teeth formed on said planetary gear is equal to one-half the number of teeth formed on said ring gear.

3. An exercise apparatus comprising:

a support frame and a ring gear supported by said support frame, said ring gear comprising an effective working diameter and being generally fixed relative to said support frame;

a crank supported for rotation about a crank axis relative to said support frame, said crank comprising an effective crank-arm length;

a planetary gear positioned within and engaged with said ring gear, said planetary gear being rotationally connected to said crank about a planetary gear axis and comprising an effective working diameter, said planetary gear axis being generally parallel to and offset from said crank axis;

a foot-pedal rotationally connected to said planetary gear, whereby said foot-pedal follows a substantially elliptical foot-path as pedal circulates about said planetary gear axis and said crank rotates about said crank axis; and said effective working diameter of said planetary gear being equal to about twice said effective crank-arm length of said crank.

4. An exercise apparatus comprising:

a support frame and a ring gear supported by said support frame, said ring gear comprising an effective working diameter and being generally fixed relative to said support frame;

a crank supported for rotation about a crank axis relative to said support frame, said crank comprising an effective crank-arm length;

a planetary gear positioned within and engaged with said ring gear, said planetary gear being rotationally connected to said crank about a planetary gear axis and comprising an effective working diameter, said planetary gear axis being generally parallel to and offset from said crank axis:

a foot-pedal rotationally connected to said planetary gear, whereby said foot-pedal follows a substantially elliptical foot-path as pedal circulates about said planetary gear axis and said crank rotates about said crank axis;

a major axis of said elliptical foot-path being greater than twice said effective crank-arm length; and said major axis of said elliptical foot-path being about quadruple said effective crank-arm length.

5. An elliptical foot-path exercise apparatus comprising:

a support frame;

a crank rotatable relative to said support frame about a crank axis, said crank having an effective crank-arm length;

a foot pedal in mechanical communication with said crank, said foot pedal being sized and arranged relative to said crank so as to follow a substantially elliptical foot-path relative to said support frame and a major axis of said substantially elliptical foot-path being greater than twice said effective crank-arm length;

a planetary gear mechanically coupling said crank to said foot pedal, said planetary gear comprising an effective working diameter and being sized and arranged to engage a sun/ring gear so as to form an epicyclic gear train, and said sun/ring gear comprising an effective working diameter; and said effective working diameter of said planetary gear being equal to one-half said effective working diameter of said sun/ring gear.

* * * * *

UNITED STATES PATENT AND TRADEMARK OFFICE

CERTIFICATE OF CORRECTION

PATENT NO. : 7,163,491 B2
APPLICATION NO. : 10/720834
DATED : January 16, 2007
INVENTOR(S) : John Rufino It is certified that error appears in the above-identified patent and that said Letters Patent is hereby corrected as shown below:

Title Page, item [75] Column 1 (Inventor), line 1, please delete "Whittier, CA" and insert therefore -- Dolores, CO --.

Title Page, item [73] Column 1 (Assignee), line 1, after "Inc.", please insert -- dba Star Trac --.

At Column 7, line 13, please delete "180°apart" and insert therefore -- 180° apart --.

Column 10, line 6, please delete "axis:" and insert therefore -- axis; --.

Signed and Sealed this

Twenty-first Day of August, 2007

JON W. DUDAS
*Director of the United States Patent and Trademark Office*